US011377294B1

(12) United States Patent
Alspaugh

(10) Patent No.: US 11,377,294 B1
(45) Date of Patent: Jul. 5, 2022

(54) PACKAGING TRAY FOR ROLLABLE OBJECTS

(71) Applicant: Amazon Technologies, Inc., Seattle, WA (US)

(72) Inventor: David Alspaugh, Seattle, WA (US)

(73) Assignee: Amazon Technologies, Inc., Seattle, WA (US)

( * ) Notice: Subject to any disclaimer, the term of this patent is extended or adjusted under 35 U.S.C. 154(b) by 244 days.

(21) Appl. No.: 15/670,414

(22) Filed: Aug. 7, 2017

Related U.S. Application Data

(60) Provisional application No. 62/524,817, filed on Jun. 26, 2017.

(51) Int. Cl.
*B65D 85/20* (2006.01)
*B65D 5/50* (2006.01)
*B65D 85/08* (2006.01)

(52) U.S. Cl.
CPC ..... *B65D 85/20* (2013.01); *B65D 5/503* (2013.01); *B65D 85/08* (2013.01)

(58) Field of Classification Search
CPC ..... B65D 85/20; B65D 85/08; B65D 5/503; B65D 5/5026; B65D 85/672; B65G 15/40; Y10T 225/252; Y10T 225/24
USPC ..... 206/564, 734, 770; 294/172, 144; 225/41, 51
See application file for complete search history.

(56) References Cited

U.S. PATENT DOCUMENTS 3,363,748 A * 1/1968 Hood ..... B65D 5/5026 206/770
2009/0308289 A1* 12/2009 Ferguson ..... B31D 5/0086 108/51.3

FOREIGN PATENT DOCUMENTS

EP 0671333 A1 * 9/1995 ..... B65D 5/5035

OTHER PUBLICATIONS

15670414 STIC Search Results (Year: 2019).*

* cited by examiner

*Primary Examiner* — Anthony D Stashick
*Assistant Examiner* — James M Van Buskirk
(74) *Attorney, Agent, or Firm* — BakerHostetler

(57) ABSTRACT

A tray for restraining movement of a rollable object, such as one that can roll or rock out of position on a conveyor, is formed of a single sheet. The tray includes a base and upstanding structures.

12 Claims, 3 Drawing Sheets

PACKAGING TRAY FOR ROLLABLE OBJECTS

CROSS-REFERENCE TO RELATED APPLICATIONS

This application claims priority to U.S. Application No. 62/524,817, filed Jun. 26, 2017, the contents of which are incorporated herein by reference in their entirety.

BACKGROUND

Modern fulfillment centers, warehouses, and the like handle an enormous number of commercial products of various shapes and sizes. Products (that is, items) often are carried in totes on conveyors or other transport systems. Totes often use well-known means for identifying the product or products within the tote, which enables a system or process the items in the vast throughout required in a commercial fulfillment center and the like.

Because a conventional tote has sidewalls, totes can contain products or packages that are rollable. Rollable products or packages (that is, those having a curved surface that can roll or rock), referred to herein as "objects," when not in a tote are difficult to handle on conveyors or other systems that move the products. In this regard, conveyor systems and other transport systems or packaging systems require accurate information about the location of a product to reliably handle the products, especially in an automated setting. Products that roll or rock out of position can be, of course, detrimental to the operation of the handling and packaging functions.

DETAILED DESCRIPTION OF ILLUSTRATIVE EMBODIMENTS

In some modern fulfillment centers, warehouses, or courier service company facilities, and the like, products or packages move on either a continuous belt conveyor or on several, end-to-end short conveyors. In this regard, the products or packages (that is, the "objects") can be carried directly on the belt without being housed in a tote. The objects can be singulated or otherwise spaced and moved on the conveyors or conveyor segments in several ways.

For example, end-to-end conveyors can be individually controlled by starting and stopping or controlling the conveyor speed. A sensor, such as a photoelectric sensor, can determine the location of the leading edge of the object, and the motor revolutions can be determined with an encoder such that the position of the package on the belt is accurately known.

But the position of the products can be uncertain when the object is capable of moving, such as rolling or rocking, on the belt. For example, where the object has a curved outer surface (such as when the object is a right angle cylinder), the object can roll or rock upon acceleration or deceleration of the belt after the object passes the photoelectric sensor.

Upon rolling or rocking, the location of the object might not be known or the object might not be in its expected location. The uncertainty or inaccuracy of this location information can, in some circumstances, cause the object to fail to be picked up by a robot or other automated system or to be properly inducted into a downstream conveyor system.

Figure 1:
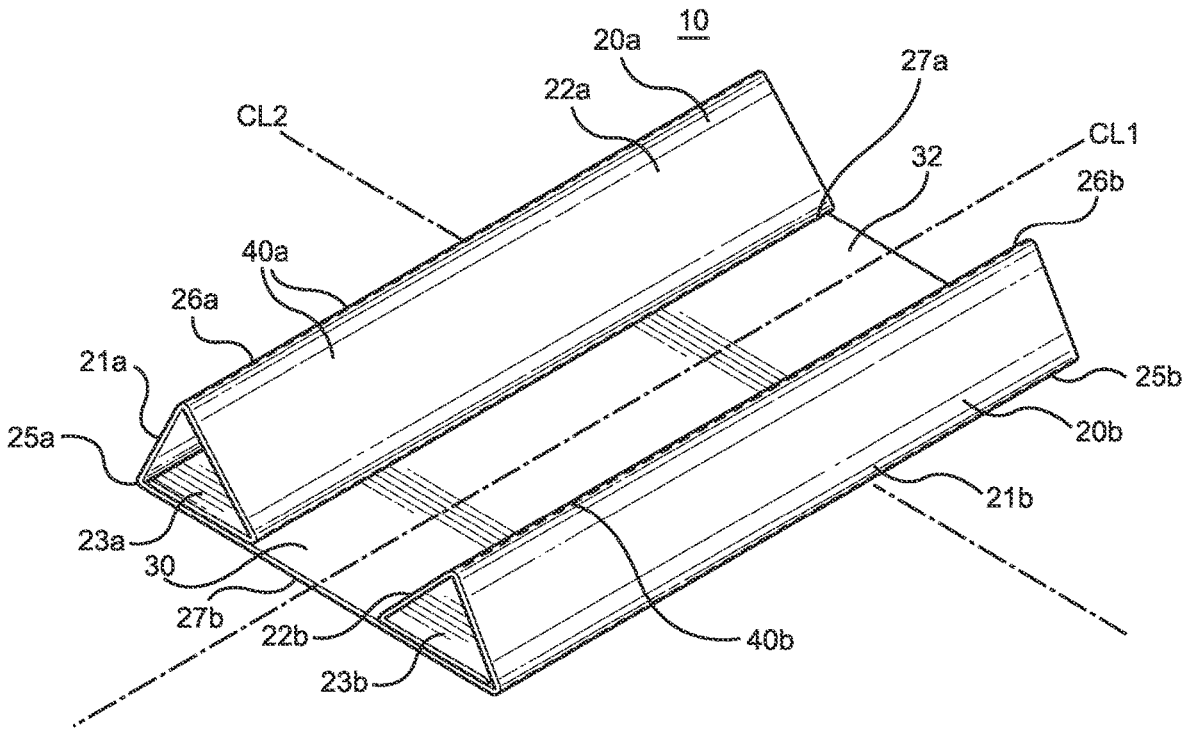
FIG. 1 is a perspective view of a first embodiment tray.
Figure 5:
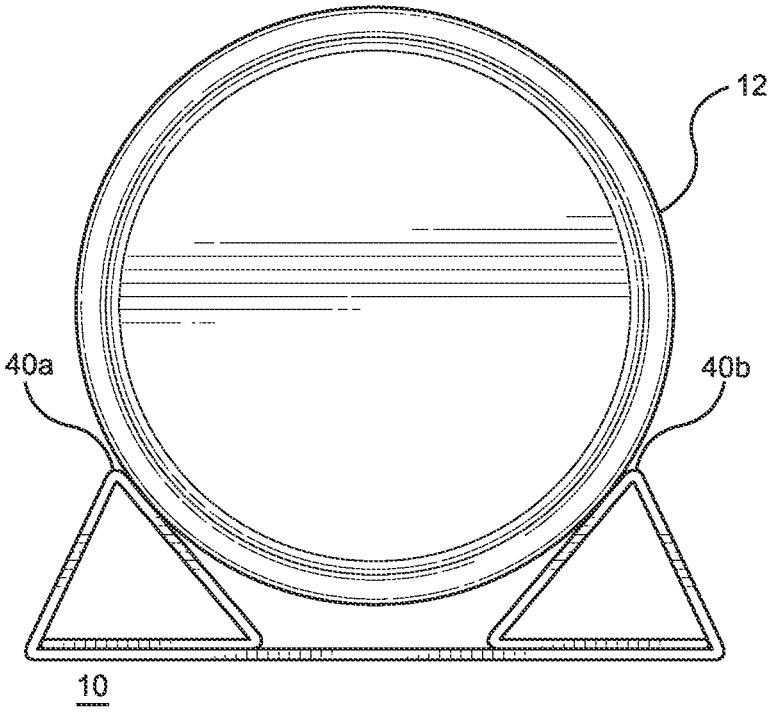
FIG. 5 is the side view of the tray of FIG. 3 shown with a rollable object engaged with the tray.

Referring to FIGS. 1 and 5, an assembled V-tray or tray 10 is a unitary structure that is capable of restraining movement of a rollable object while the tray carries the object. The specification uses the term "rollable" to refer to products or packages that have a curved outer surface, such as but not limited to a right circular cylinder having a circular cross section as shown by object 12 in FIG. 5, that can roll or rock on at least one axis. The tray defines a first axis CL1 that is parallel to the longitudinal axis of object 12 and a second axis CL2 that is perpendicular to the first axis CL1. In the embodiments shown in the figures, axis CL1 defines a longitudinal centerline and defines the longitudinal or lengthwise direction of the upstanding structures that retain object 12, as explained more fully below. Preferably, tray 10 is symmetrical about first axis CL1 and symmetrical about second axis CL2. Tray 10 can optionally be an insert that is inserted into an outer box for shipping.

Tray 10 includes a pair of upstanding structures 20*a* and 20*b* on opposing sides of first axis CL1 and a base panel 30 from which upstanding structures 20*a* and 20*b* vertically extend. The references numerals are appended with an "a" and a "b" designation to refer to corresponding, paired structures that (preferably) are the same, but on opposing sides, and preferably mirror image. The present invention is not limited to symmetrical structures, however, as the letter designations are not intended to limit the scope of the present invention, but rather merely are for ease of describing only one embodiment. Moreover, the terms "side" and "end" are chosen merely for ease of description of one embodiment, and are not intended to limit the scope of the invention. Where convenient, the structures are referred to by reference numeral only, without the appended letter designation.

In the embodiment shown in the figures, each upstanding structure 20*a* and 20*b* is a triangular prism—that is, a three dimensional structures having a cross section in a plane perpendicular to first axis CL1 that is a triangle. The prisms 20*a* and 20*b* extend from end to end of tray 10 so as to be co-extensive in length with base panel 30.

The triangle of prism 20*a* includes and is formed by a first leg 21*a*, a second leg 22*a*, and a third leg 23*a* to form a first vertex 25*a* between first legs 21*a* and an outboard portion of base panel 30, a second vertex 26*a* between first and second legs 21*a* and 22*a*, and a third vertex 27*a* between second and third legs 22*a* and 23*a*. On the opposing side, the triangle of prism 20*b* includes and is formed by a first leg 21*b*, a second leg 22*b*, and a third leg 23*b* to form a first vertex 25*b* between first legs 21*b* and an outboard portion of base panel 30, a second vertex 26*b* between first and second legs 21*b* and 22*b*, and a third vertex 27*b* between second and third legs 22*b* and 23*b*.

Figure 2:
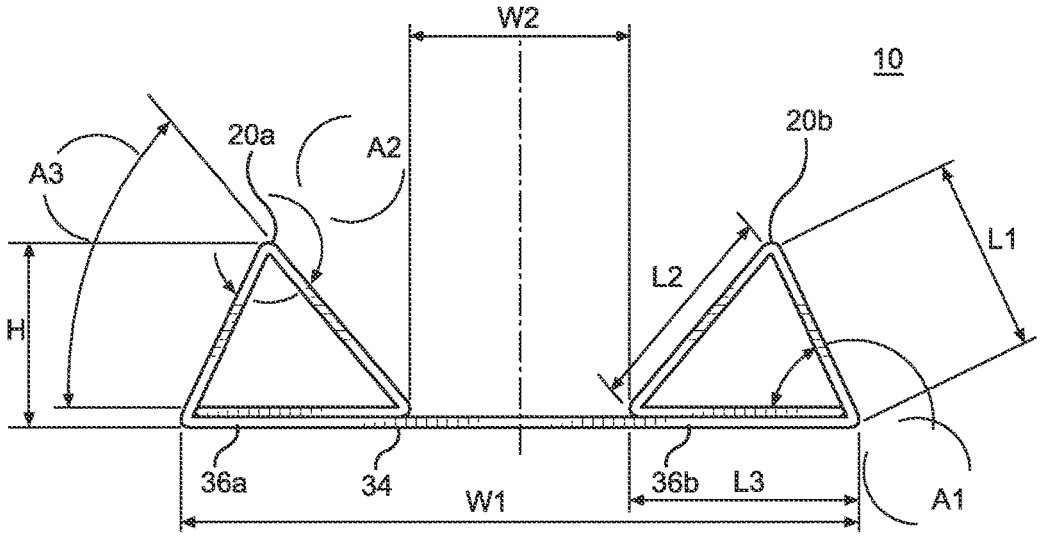
FIG. 2 is an end view of the tray of FIG. 1.
Figure 3:
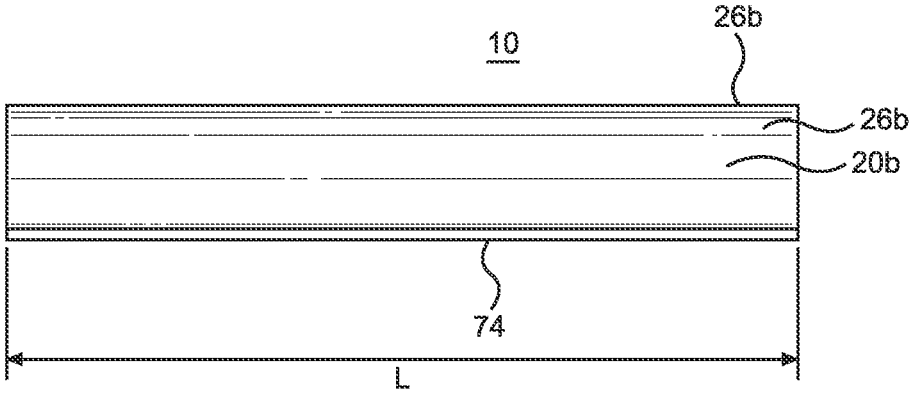
FIG. 3 a side view of the tray of FIG. 1.

Base panel 30 includes a base panel top surface 32 and an opposing base panel bottom surface 34. Outboard portions 36*a* and 36*b*, as best shown in FIG. 2, of base panel 30 extend end to end on opposing sides of first axis CL1 and are defined as the portions of base panel 30 that extend under or are covered by upstanding structures 20*a* and 20*b*. In the embodiment shown in the figures, the underside surface of third legs 23*a* and 23*b* are parallel to and in contact with the top side of base outboard portions 36*a* and 36*b*. As explained more fully below, third legs 23*a* and 23*b* optionally have a means to affix them to outboard portions 36*a* and 36*b*, respectively. For example, the third leg has a bottom surface that is adhered to an upper surface of the base panel, such as by an adhesive, double sided tape, or like means. In addition or alternatively, outboard portions 36*a* and 36*b* may have tabs that are inserted into corresponding apertures in first legs 23*a* and 23*b* (not shown in FIGS. 1 and 2) to affix the legs to the base.

A contact surface 40*a* may be defined by the surface and/or line (parallel to first axis CL1) defined by second vertex 26*a* and/or second leg 22*a*. And a contact surface 40*b* may be defined by the surface and/or line (parallel to first axis CL1) defined by second vertex 26*b* and second leg 22*b*. Thus, when object 12 is in its retained position in tray 10, as shown in FIG. 5, such that try 10 carries object 12, the outer surface of object 12 engages (that is, contacts) surfaces 40*a* and 40*b*. The specific portions of contact portions 40*a* and 40 that object 12 contacts will depend on the diameter of object 12 and, where applicable, its shape, and on the dimensions of tray 10. In this regard, an object 12 having a smaller relative diameter than that shown in FIG. 5 may contact second legs 22*a* and 22*b* and a portion of base panel 30. For another example, if the object is oval in cross section (not shown in the figures), the object may contact the vertex 26 on one side, the second leg 22 on the other side, and also a portion of base panel 30. If the object has a significantly larger relative diameter, it might contact only vertices 26*a* and 26*b*. Other contact possibilities are contemplated.

In this regard, the term "contact surface" as used herein refers to the vertices 26*a* and 26*b* and second legs 22*a* and 22*b* to indicate the main structures that are configured to retain the object even if a particular object does not actually contact both surfaces. Thus, the present invention is not limited to structures or combinations for which contact is achieved at surfaces 22 and 26, nor is the invention limited to structures or combinations that contact only surfaces 22 and 26. Further, the present invention is not limited to a continuous contact along the length (that is the dimension parallel to first axis CL1), nor are the contact surfaces required to be parallel to axis CL1, nor continuous, nor linear (that is, straight). For example, legs 21 and 22 and/or base 30 may include recesses into which object 12 can reside for enhanced retention.

The dimensions of the components of tray 10 can be chosen according to the particular intended functions or uses of the tray and the desired product size ranges and cross sectional shapes of the products. FIG. 2 shows a particular embodiment of a tray 10 in which base panel 30 (including outboard portions 36*a* and 36*b*) has a width dimension W1 of 5.0 inches and the uncovered portion of base panel 30 has a width dimension W2 of 1.7 inches. The height H of each upstanding structure is approximately 1.3 inches.

The orientation of first leg 21 forms an included angle A1 between first leg 21 and third leg 23, which for purposes of defining the angles leg 23 is presumed to be horizontal, of 65 degrees. Angle A2 between first and third legs 21 and 22 is 65 degrees. Angle A3 between second and third legs 22 and 23 is 50 degrees. Preferably, the lengths L1, L2, and L3 of the legs are chosen to achieve the angles A1, A2, and A3, widths W1 and W2, and height H. All of the dimensions provided herein are illustrative, and the specific dimensions and angles may be chosen according to the particular parameter of the application, such as expected shape, dimensions, and variability of the object; speed, acceleration, and deceleration of the belt carrying the tray; and like parameters, as will be understood by persons familiar with packaging technology.

The materials forming tray 10 can include any sheet material, as described more fully below. For example, tray 10 may be formed of corrugated fiberboard, card stock, paperboard, or a plastic.

Preferably, in operation, object 12 is retained in tray 10 and is restrained from moving side-to-side (that is, in the direction of second axis CL2) while tray 10 carries object 12, either at rest or while moving, accelerating, and decelerating. Thus, the restraining function of tray 10 is useful when tray 10 is at rest and also when the base bottom surface 34 is on a conveyor for transferring object 12. In some configurations, tray 10 will be oriented to travel parallel to first axis CL1, such that object 12 is prevented from transverse or sideways movement (that is, in the direction parallel to transverse axis CL2) on the conveyor. This configuration is useful, for example, in conveyor configurations in which a first conveyor discharges objects onto a second conveyor that is perpendicular to the first conveyor. In other configurations, tray 10 and object 12 can are orientated to travel in a direction parallel to second axis CL2.

Preferably, the proximal and distal ends (that is, the outermost portions of tray 10 along first axis CL1) are open such that the ends do not have upstanding structures relative to base panel 30. In this regard, the ends enable objects 12 to be received between upstanding structures 20*a* and 20*b* without interference, although such structure or lack of structure is not required.

Figure 4:
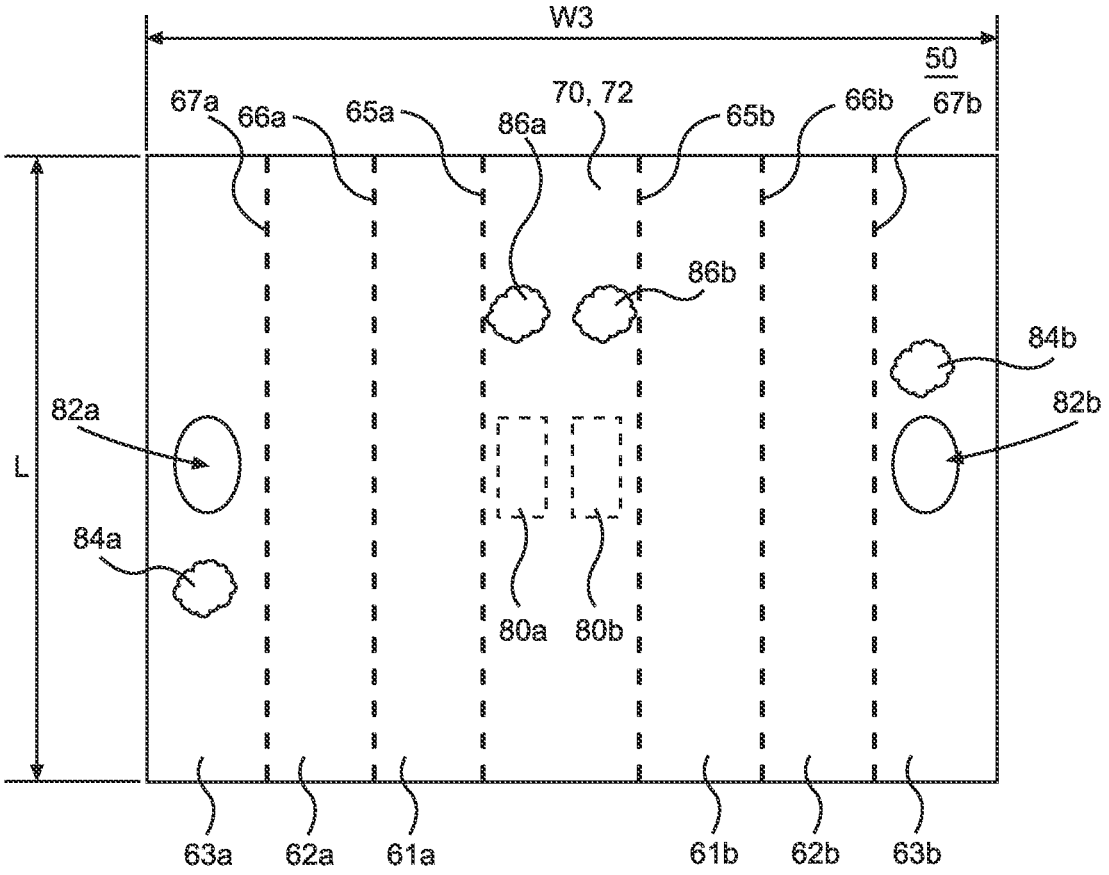
FIG. 4 is a schematic (not to scale) view of a die-cut flat sheet that is used to form the tray of FIG. 1.

Referring to FIG. 4, a die cut sheet 50 is illustrated schematically and not to scale. Sheet 50 is the intermediate structure from which tray 10 is formed. Sheet 50 can be a corrugated fiberboard, card stock, paperboard, or a plastic. The phrases "corrugated fiberboard, card stock, paperboard" are intended broadly to encompass any sheet product that includes a paper component, either in a layer, mixture, or chemical composition. The term "plastic" is intended broadly to encompass any sheet material that includes a polymer, either as a layer, mixture, or chemical composition. The plastic sheet may, for a non-limiting example, be a rigid sheet.

Sheet 50 includes a base panel 70 and, extending outwardly in the direction parallel to axis CL2, a pair of opposing first side panels 61*a* and 61*b*, a pair of second side panels 62*a* and 62*b*, and a pair of third side panel 63*a* and 63*b*. The first panels 61*a* and 61*b* are separated from base panel 70 by first scores 65*a* and 65*b*. Second panels 62*a* and 62*b* are separated from first panels 61*a* and 61*b* by second scores 66*a* and 66*b*. Third panels 63*a* and 63*b* are separated from second panels 62*a* and 62*b* by third scores 67*a* and 67*b*. Scores 65, 66, and 67 facilitate folding of the sheet 50. The score can be a groove or a slice that is cut into or in another way formed part way through sheet 50, or can be perforations through at least part of sheet 50, or can be any other score means as will be understood by persons familiar with relevant packaging or box technology.

Accordingly, the preferred shape of sheet 50 is a rectangle such that the panels each preferably extend along the first axis CL1 by a dimension L. Length L of sheet 50 is also the length of tray 10, and for illustration can be four inches, six inches, or eight inches. Other lengths are contemplated. Together, the panels sum to dimension W3 in the direction parallel to second axis CL2. Sheet 50 is generally planar, which term is used to refer to the generally flat nature of sheet 50, even though sheet 50 may include surface imperfections on unevenness common in commercial products, raised or recessed portions, scores, cut-outs, curls, and the like.

To form tray 10 from sheet 50, the panels 61*a*, 62*a*, and 63*a* are folded such that the sheet 50 hinges at scores 65*a*, 66*a*, and 67*a*. Panel 61*a* thus forms leg 21*a*. Panel 62*a* forms leg 22*a*. Panel 63*a* forms leg 23*a*. In this way, panels 61*a*, 62*a*, and 63*a* are folded into a configuration that forms the triangle shape of first upstanding structure 20*a*. Panels 61*b*, 62*b*, and 63*b* likewise are folded to form upstanding structure 20*b*.

Upon contact of the underside of panel 63*a* with the surface 72 of base panel 70 that forms underlying portion 36*a*, in some embodiments, a means to affix leg 23*a* to panel 36*a* can stiffen or secure the shape upstanding portions 20 of tray 10. As illustrated schematically in FIG. 4, an adhesive 84*a* (illustrated in dashed lines) can be applied to the underside of panel 63*a* which when folded contacts the upper side of panel 36*a*. Thus, adhesive 84*a* can affix leg 23*a* to panel 36*a* by adhesion. An adhesive 86*a* can be applied to the portion of panel 70 that forms underlying portion 36*a* to adhere the leg to the base panel. Adhesives 84*a* and 86*a* can be placed at corresponding portions such that adhesive 84*a* contacts 86*a*, adhesive 84*a* may be positioned such that is does not contact adhesive 86*a*, or only one of either adhesive 84*a* or 86*a* may be employed in the embodiments using adhesives. The term "adhesive" or "adhere" is broadly intended to refer to any means for permanent or temporary bonding, including for example double sided tape, pressure sensitive materials, hot glue, and the like.

Further, the portion of panel 70 that forms underlying portion 36*a* may include a tab 80*a*, which preferably is die cut into sheet 50 such that tab 80*a* can be folded upwardly out of the plane of sheet 50. A corresponding slot or aperture 82*a* is formed into panel 63*a* such that when panel 63*a* is folded into position to form leg 23*a*, tab 80*a* is inserted into aperture 82*a* to affix leg 23*a* and base panel 36*a* together. Likewise, a tab 80*b* and slot or aperture 82*b* has the same structure and function for leg 23*b* and base panel 36*b* as that described for tab 80*a*. Employing means to secure the upstanding portions 20 to the base is optional, regardless whether by adhesive or structural tabs and the like, as the weight or object 12 alone may aid in retaining the shape of the upstanding portion in some configurations.

Alternatively, the side structures, such as each prism shape described herein, may be formed without a third leg (as identified by reference numerals 23*a* and 23*b*) or other structure that lies on or parallel to panel 70. In this alternative (not shown in the figures), a tab extends from each opposing side of the sheet 50 (that is, from the sides defined by dimension L). Slots or apertures that correspond to the tabs are formed on panel 70. In its assembled state, the tabs extend into or through the apertures to hold the side structure in its raised configuration, and thus adhesives such as adhesives 84 and 86 and internal tabs and apertures such as tabs 80 and apertures 82 are optional and in some embodiments may be eliminated. To form the alternative embodiment, the panel has only two scores, which when bent position the tabs can to engage the apertures. In a manual assembly process, an assembler's thumbs can push the tabs into or through the apertures to secure or lock the structure in place.

The present invention is not limited to the particular structures or embodiments described above. For just a few examples, the upstanding structures are not limited to a triangular cross sectional shape. For example, the inventors contemplate and the invention encompasses that a square, rectangle, or other polygonal or curved shape can be suitable depending on the particular parameters and goal of the tray. And the upstanding structures are not limited to the position or orientations explained herein. Further, the present invention is described using figures and text of merely one embodiment, which is intended merely to illustrate aspects of the inventive concepts. The present invention is not intended to be limited to the drawings and accompanying text, but rather it is intended that the scope of the invention be defined by the full breadth of the claims.

What is claimed is:

1. A tray for holding a rollable object, the tray defining a first axis and a second axis that is perpendicular to the first axis, the tray comprising:

a generally planar base panel having a pair of opposing ends lying on the first axis; and a pair of opposing elongate side structures that are parallel to the first axis, the pair of opposing side structures extending vertically upward from the base panel, each one of the side structures including a contact surface adapted for contacting the rollable object to stabilize the rollable object, each one of the side structures having a triangular cross-section with respect to a plane that is perpendicular to the first axis and the second axis such that the contact surface includes a vertex of the triangular cross-section, each one of the triangular cross-sections being defined by a first leg that is relatively outboard-facing, a second leg that is relatively inboard-facing, and a third leg that is approximately parallel to the base panel, the third leg lying on the base panel, wherein the base panel and the opposing elongate side structures are formed from a unitary sheet.

2. The tray of claim 1, wherein each one of the side structures is a triangular prism such that the contact surface extends in parallel to the first axis.

3. The tray of claim 1, wherein the third leg of each of the side structures is affixed to the base panel.

4. The tray of claim 3, wherein the third leg of each of the side structures has a bottom surface that is adhered to an upper surface of the base panel.

5. The tray of claim 1, wherein the sheet comprises at least one of corrugated fiberboard, card stock, paperboard, or plastic.

6. The tray of claim 1, wherein the opposing ends of the base panel are open.

7. The tray of claim 1, wherein the tray is symmetrical about the first axis and the tray is symmetrical about the second axis.

8. A die-cut sheet that is substantially planar and that defines a first axis and a second axis that is perpendicular to the first axis, the sheet comprising:

a substantially planar base panel having a pair of ends lying on the first axis and a pair of opposing sides lying on the second axis;

a first tab and a second tab cut into the base panel, the first tab and second tab being configured to be folded out of the plane of the base panel;

opposing planar first side panels outboard of the sides of the base panel, wherein the first side panels are separated from the base panel by a pair of first scores;

opposing planar second side panels outboard of the first side panels, wherein the second side panels are separated from the first side panels by second scores;

opposing planar third side panels outboard of the second side panels, wherein the third side panels are separated from the second side panels by third scores; and a first aperture defined by one of the third side panels and a second aperture defined by another of the third side panels, wherein the first, second, and third side panels are adapted for being bent at the first, second, and third scores, respectively, the first aperture is adapted to receive the first tab, and the second aperture is adapted to receive the second tab, to form triangular prisms on the opposing sides of the base panel suitable for stabilizing a rollable object.

9. The sheet of claim 8, wherein the sheet comprises at least one of corrugated fiberboard, card stock, paperboard, or plastic.

10. The tray of claim 1, wherein the third leg and the second leg define one of the vertices of the triangular cross-section.

11. The die-cut sheet of claim 8, wherein the first scores, the second scores, and the third scores are grooves or slices that are extend at least party way through the die-cut sheet.

12. The die-cut sheet of claim 8, wherein the die-cut sheet has a rectangular shape.

* * * * *